US005363544A

United States Patent [19]

Wells et al.

[11] Patent Number: 5,363,544

[45] Date of Patent: Nov. 15, 1994

[54] MULTI-STAGE DUAL WALL HYDROFORMING

[75] Inventors: Gary L. Wells, Kalamazoo; James R. Dehlinger, Ada; Donald R. Rigsby, Jenison, all of Mich.

[73] Assignee: Benteler Industries, Inc., Grand Rapids, Mich.

[21] Appl. No.: 65,126

[22] Filed: May 20, 1993

[51] Int. Cl.[5] ..... B21D 39/08; B21D 3/00; B23P 11/02; F16L 9/18

[52] U.S. Cl. ..... 29/523; 29/33 D; 29/455.1; 29/507; 29/DIG. 43; 72/58; 72/62; 72/367; 138/114; 138/148

[58] Field of Search ..... 29/455.1, 506, 507, 29/508, 523, 890.036, 33 D, 512, DIG. 41, 43; 72/56, 58, 61, 62, 367, 368, 369; 138/112, 113, 114, 143, 148, 149, 140

[56] References Cited

U.S. PATENT DOCUMENTS

| | | | |
|---|---|---|---|
| 385,119 | 6/1888 | Johns | 138/151 |
| 464,737 | 12/1891 | Stapley . | |
| 1,751,914 | 3/1930 | Greve | 138/148 |
| 1,764,561 | 6/1930 | Gulick . | |
| 2,652,121 | 9/1953 | Kearns, Jr. et al. | 170/159 |
| 2,713,314 | 7/1955 | Leuthesser, Jr. | 113/44 |
| 2,718,048 | 9/1955 | Sedgwick | 29/463 |
| 2,734,473 | 2/1956 | Reynolds | 113/44 |
| 2,761,525 | 9/1956 | Moss | 138/143 |
| 2,837,810 | 6/1958 | Ekholm | 29/157 |
| 2,913,870 | 11/1959 | Lashley | 138/143 |
| 3,002,269 | 10/1961 | Hopkins | 29/441 |
| 3,133,612 | 5/1964 | Sailler | 181/36 |
| 3,173,196 | 3/1965 | Grimm | 29/157 |
| 3,196,905 | 7/1965 | Hills | 138/148 |
| 3,201,861 | 8/1965 | Fromson et al. | 29/455 |
| 3,206,836 | 9/1965 | Schlussler | 29/157 |
| 3,209,787 | 12/1965 | Brown et al. | 138/114 |
| 3,222,773 | 12/1965 | Zambrow et al. | 138/113 |
| 3,242,558 | 3/1966 | Selig | 138/148 |
| 3,292,731 | 12/1966 | Ballard | 181/36 |
| 3,301,277 | 1/1967 | Kelly | 138/148 |
| 3,324,533 | 6/1967 | Watteau | 29/156 |
| 3,404,445 | 10/1968 | Crouse | 29/157 |

(List continued on next page.)

FOREIGN PATENT DOCUMENTS

| | | | |
|---|---|---|---|
| 301425 | 2/1989 | European Pat. Off. | 29/523 |
| 494843A1 | 1/1992 | European Pat. Off. . | |
| 229114 | 2/1909 | Germany . | |
| 2305377 | 8/1974 | Germany . | |
| 2337479 | 2/1975 | Germany . | |
| 2944435 | 5/1981 | Germany | 29/507 |
| 130464 | 10/1979 | Japan . | |
| 88939 | 7/1980 | Japan | 29/508 |
| 122632 | 9/1980 | Japan . | |
| 112612 | 7/1983 | Japan | 29/507 |
| 046831 | 3/1985 | Japan . | |
| 63-215809A | 9/1988 | Japan . | |
| 147132 | 6/1990 | Japan | 29/523 |
| 2091341 | 1/1981 | United Kingdom . | |
| 1404667 | 6/1983 | U.S.S.R. . | |

*Primary Examiner*—Peter Dungba Vo
*Attorney, Agent, or Firm*—Price, Heneveld, Cooper, DeWitt & Litton

[57] ABSTRACT

A method of forming a dual tube conduit having a predetermined outer tube dimension, a predetermined inner tube dimension, and a predetermined gap between the tubes. A dual tube workpiece may be initially bent in one or more zones to a desired nonlinear configuration, the inner and outer tubes are hydroform expanded simultaneously to obtain the selected inner tube dimension, and the outer tube is then hydroform expanded to the desired outer tube dimension and to the desired gap therebetween, while the inner tube is held constant.

19 Claims, 2 Drawing Sheets

U.S. PATENT DOCUMENTS

| | | | |
|---|---|---|---|
| 3,435,852 | 4/1969 | Trihey | 138/135 |
| 3,443,409 | 5/1969 | Matsukin | 72/56 |
| 3,722,221 | 3/1973 | Chopin et al. | 60/282 |
| 3,786,791 | 1/1974 | Richardson | 123/65 |
| 3,903,928 | 9/1975 | Sykes et al. | 138/112 |
| 4,022,019 | 5/1977 | Garcea | 60/282 |
| 4,027,407 | 6/1977 | Kiss | 138/148 |
| 4,142,366 | 3/1979 | Tanahashi et al. | 60/322 |
| 4,185,463 | 1/1980 | Tanahashi et al. | 60/322 |
| 4,207,660 | 6/1980 | Rao et al. | 29/156 |
| 4,285,109 | 8/1981 | Kautzer et al. | 29/157 |
| 4,332,073 | 6/1982 | Yoshida et al. | 29/421 |
| 4,404,992 | 9/1983 | Sasaki et al. | 138/140 |
| 4,410,013 | 10/1983 | Sasaki et al. | 138/149 |
| 4,413,657 | 11/1983 | Sasaki et al. | 138/149 |
| 4,513,598 | 4/1985 | Costabile | 72/62 |
| 4,567,743 | 2/1986 | Cudini | 72/61 |
| 4,619,292 | 10/1986 | Harwood | 138/113 |
| 4,656,712 | 4/1987 | Harwood et al. | 29/157 |
| 4,656,713 | 4/1987 | Rosa et al. | 29/157 |
| 4,711,088 | 12/1987 | Berchem et al. | 60/321 |
| 4,744,237 | 5/1988 | Cudini | 72/367 |
| 4,759,111 | 7/1988 | Cudini | 72/523 |
| 4,829,803 | 5/1989 | Cudini | 72/367 |
| 5,054,185 | 10/1991 | Usui | 29/455.1 |
| 5,100,047 | 3/1992 | Nakagawa | 29/898.08 |
| 5,170,557 | 12/1992 | Rigsby | 29/890 |

MULTI-STAGE DUAL WALL HYDROFORMING

BACKGROUND OF THE INVENTION

This invention relates to hydroforming of dual wall tubular products such as engine exhaust conduits, and particularly to hydroforming such products to obtain a uniform controlled spacing or gap between the inner and outer walls.

In U.S. Pat. No. 5,170,557 is set forth a hydroforming process for forming a dual wall conduit, with a minimum air gap between the inner and outer walls being assured. Often it is desirable to have a predetermined uniform air gap, not just a minimum gap, between the walls. Specifically, for example, an auto manufacturer may want a dual wall engine exhaust conduit with a two and one-half inch outer wall diameter and a two and one-quarter inch inner wall diameter, and a uniform spacing or gap between them. The prior known technology does not enable that to be assured. This is particularly so when the dual wall conduit is bent into various nonlinear configurations, as is usually done. Such bending tends to cause reduction in the conduit diameter, i.e., necking down of the walls, at the bend zones, and formation of wrinkles or bulges adjacent the bend zones. When subsequently hydroform expanded in the conventional way in which only the outer wall is expanded outwardly to the surface of the hydroforming die cavity, the result is an air gap of differing amounts and configurations along the conduit length.

SUMMARY OF THE INVENTION

An object of this invention is to provide a method and apparatus capable of forming a dual tube conduit, even one with a nonlinear configuration, having a predetermined outer tube dimension, a predetermined inner tube dimension, and a predetermined uniform desired spacing or gap between the tubes.

The dual tube workpiece is initially bent in one or more zones to the desired nonlinear configuration, the inner and outer tubes are hydroform expanded simultaneously to obtain the selected inner tube dimension, and the outer tube is then hydroform expanded to the desired outer tube dimension and to the desired gap or spacing therebetween, while the inner tube is held constant.

The inner tube has openings along its length, specifically adjacent to and spaced somewhat from the ends thereof. During the time that both the inner and outer tubes are expanded simultaneously, these openings are sealed with an end plug seal so that hydroforming fluid only enters the inner tube to expand both tubes to a first selected dimension. This not only gives a controlled expansion but also reverses the necking down characteristic and the wrinkles caused by the prior bending step, and gives the inner tube the dimension required. Moreover, if there is a flaw in the inner tube, e.g., in the longitudinal seam weld of the tube, it will be detected at this stage because hydroforming fluid will escape between the tubes through the flaw and then squirt between the tubes at the ends of the workpiece, causing the pressure to noticeably drop or cease to build. Leakage of the tube will thus be apparent.

Once this first expansion step is complete, the openings in the inner tube are purposely uncovered, i.e., unsealed, and hydroforming fluid is then reinjected under pressure into the inner tube, thus flowing through the openings into the outer tube, to expand the outer tube to the selected larger size, while the inner tube remains fixed with pressure being equal on both sides thereof. Hence, both tubes will then be at the selected dimensions and the spacing or gap between them will be the desired amount, which can be uniform over the length and configuration of the conduit. The fluid is then extracted from the conduit by drainage or by forcing it out under pressure.

To accomplish this process, preferably a pair of forming mold cavities are used, the first cavity having a size larger than the initial workpiece and of a size to govern the inner tube final dimension, and the second cavity of a size larger than the first cavity and selected to establish the outer tube final dimension. These first and second cavities are each formed by having part of the cavity in one platen and the other part in a cooperative mold platen. When the platens are brought together, this completes and closes the cavities. The first mold cavity may also function as a die, i.e., when the platens are brought together to close the cavity, the cavity walls may work the metal of the workpiece to reshape it somewhat.

Although one pair of end plugs can be used for both cavities, it is normally more convenient to have two pairs of end plugs. The first pair requires a resilient, radially expandable annular seal to seal off the openings in the inner tube of the workpiece. The first pair also preferably has tapered ends to flare the workpiece ends and thereby establish locating centers, i.e., the centerline of the workpiece. The second pair of end plugs has tapered ends of a nature to not only center the workpiece in the second die cavity, but also to press and seal the flared ends of the inner and outer tubes together sufficiently during the second hydroforming stage to prevent leakage therebetween.

The first pair of end plugs has a dual actuator arrangement to operate the tapered end for flaring of the workpiece, and to subsequently activate the annular seal.

These and several other features, objects and advantages of the invention will become apparent to those skilled in this art upon studying the following specification in conjunction with the drawings.

DESCRIPTION OF THE PREFERRED EMBODIMENT

Figure 1:
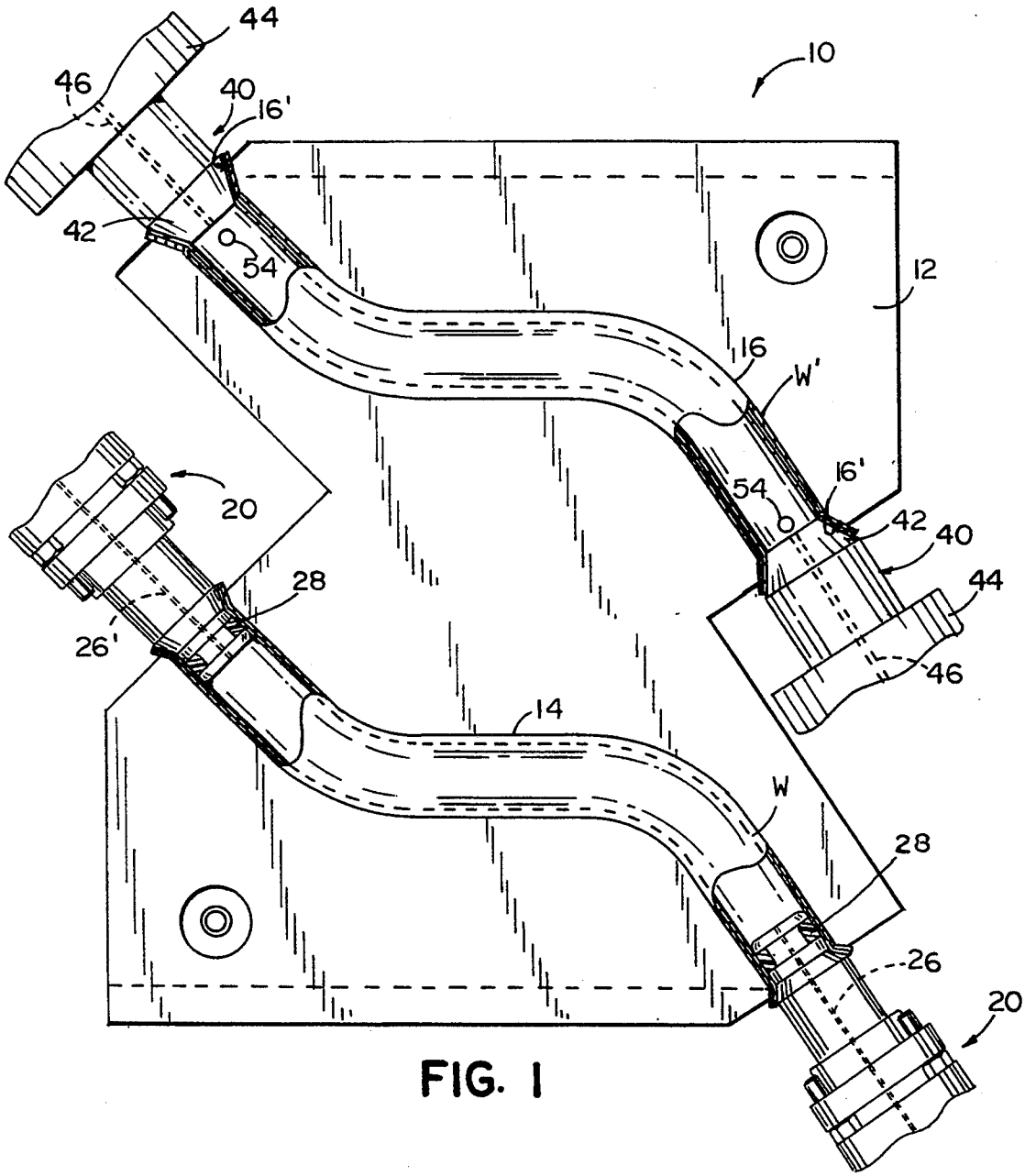
FIG. 1 is a plan view of the hydroforming apparatus of this invention, showing first and second die cavities and first and second pairs of end plug subassemblies.
Figure 3:
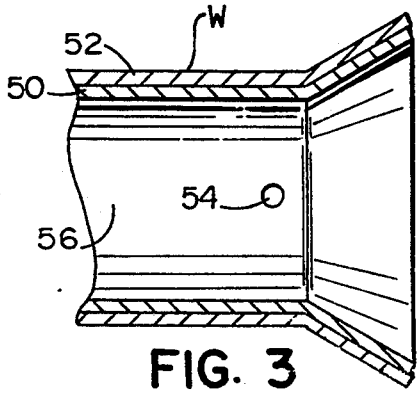
FIG. 3 is a fragmentary sectional view of an end portion of the workpiece after the ends are flared.

The complete assembly 10 there depicted includes a pair of cooperative platens 12 and 12', the lower one 12 being optionally a mirror image of the upper one 12'. These define a first mold cavity 14 and a second mold cavity 16. The diametral and circumferential dimensions of the first cavity are smaller than those of the second cavity, and are sized to provide a desired final dimension for the inner tube of the workpiece. The diametral and circumferential dimensions of the second cavity are sized to the desired final dimension of the outer tubular member of a pair of tubular members forming the workpiece, to be described in more detail hereinafter. Cavity 14 has a configuration from end to end matching that of the desired final conduit, especially a vehicle engine exhaust conduit, configured to match the requirements of a particular vehicle and shown, for example, to have a pair of bend zones between the opposite ends thereof. The bend zones in these two forming cavities 14 and 16 correlate with each other positionally. Using the present technology, a previously bent exhaust pipe conduit workpiece W is first placed in cavity 14, operated upon, and then placed in cavity 16 and operated upon further.

Figure 2:
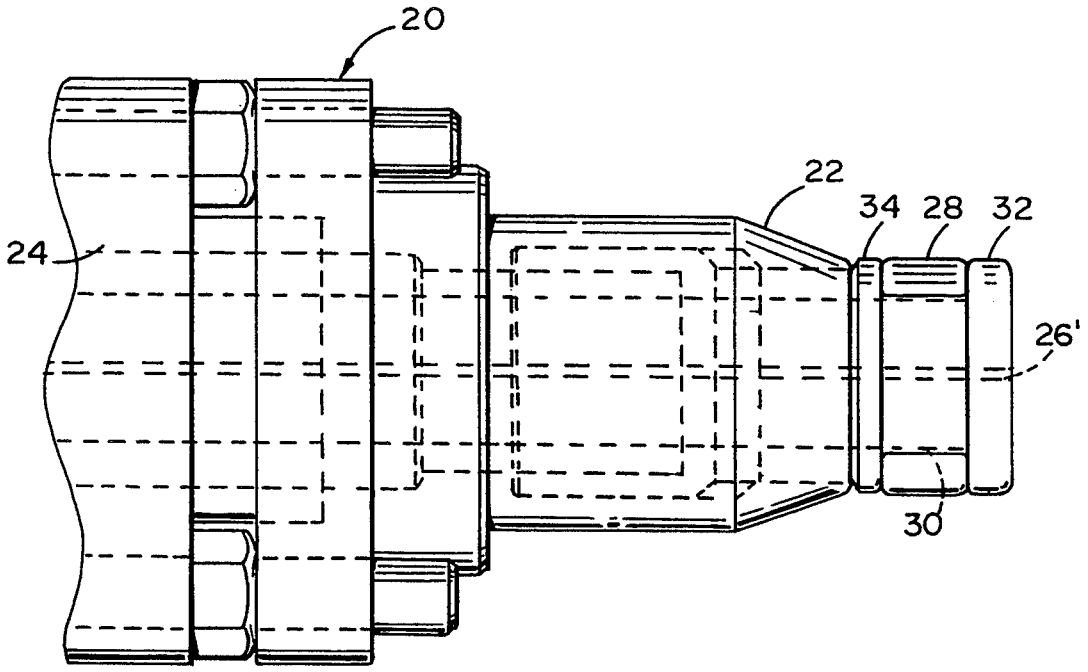
FIG. 2 is an enlarged, elevational view of one of the first pair of end plug subassemblies.
Figure 4:
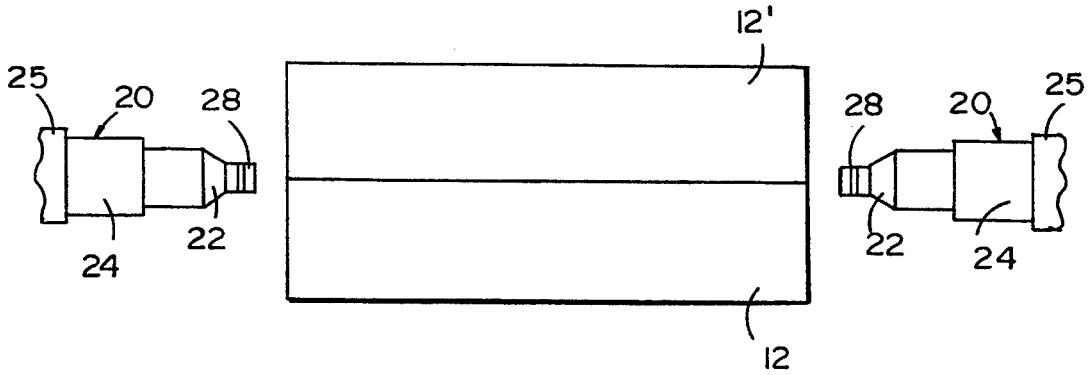
FIG. 4 is a diagrammatic elevational view of the hydroforming apparatus.

At the opposite ends of the first cavity 14 is a first pair of special end plug subassemblies 20. Each of these is shown in more detail in enlarged fashion in FIG. 2. Each includes a frustoconical, tapered nose 22 oriented toward the cavity, and having a diameter which varies from the smallest diameter outer end portion, smaller in diameter than the diameter of cavity 14 and the inside diameter of the inner tube, to the largest diameter portion which is larger than the diameter of cavity 14. Each tapered nose is shiftable axially on the central axis of subassembly 20 for extension and retraction, by a first power actuator 24, preferably a fluid cylinder, with nose 22 being attached to the piston rod of the cylinder. Tapered nose 22 on the two end plugs is for the purpose of flaring the ends of the conduit workpiece W inserted in cavity 14, and holding the workpiece on center in the cavity. End plug subassembly 20 also includes a radially expandable annular, deformable, resilient seal 28 mounted around a central rod 30 which has an enlarged flange-type collar 32 on its outer end and against the axial outer end of seal 28. The other axial inner end of seal 28 abuts against collar 34 adjacent the outer end of tapered nose 22. This entire assembly can be axially advanced by fluid cylinder 25 into the cavity and workpiece, or retracted therefrom. The other fluid cylinder 24 has a short stroke to shift collar 34 axially outwardly to compress and axially squeeze resilient seal member 28, causing its outer diameter and inner diameter to radially expand, and thereby seal the ends of the workpiece. The at-rest smaller diameter of seal 28 is purposely made smaller than the interior diameter of workpiece W, while the expanded diameter is equal to, or even slightly greater when unrestrained, than the inner diameter of the workpiece, to form a fluid tight seal therein and against rod 30 for purposes to be explained hereinafter. These annular seals extend sufficiently into the workpiece to seal off openings 54 from the inner ends of the end plugs.

Extending through end plug subassemblies 20 to communicate with a workpiece in cavity 14 is a liquid conducting passage 26 for entry and exit of hydroforming fluid such as water, as explained more fully hereinafter.

The second pair of end plug subassemblies 40 for second cavity 16 is also characterized by having a tapered, frustoconical nose 42, the smaller end diameter of which is oriented toward cavity 16, and is smaller in diameter than this second cavity 16, while the larger diameter portion is larger in diameter than the diameter of cavity 16. A fluid cylinder power actuator 44 axially shifts the end plug with its tapered nose toward and away from cavity 16.

In the second pair of end plugs 40, at least one has a liquid conducting passage 46 therethrough into the modified workpiece W' in cavity 16 for filling and pressurizing hydroforming liquid, normally water, in this workpiece, in a manner to be described more fully hereinafter.

The initial workpiece to be hydroform-expanded comprises an inner, metal, preferably steel, and most preferably stainless steel, tube or tubular element 50, and an outer tubular element 52, also of metal, and preferably steel, most preferably stainless steel. The inner diameter of outer tube element 52 basically coincides with the outer diameter of inner tube element 50 such that normally the initial workpiece has 360° contact between the two elements along the length thereof. The inner element has at least one opening 54 extending through its wall thickness from the inner cavity 56 defined by the inner element to the inner wall of the outer element. The one or more openings along the length of the inner element are located only adjacent one end or both ends, preferably both ends, of the inner element, spaced from the open ends of the element an amount to be inward of the tapered noses 22 when in the first cavity, and inwardly of tapered noses 42 when in the second cavity. The tube elements of the initial workpiece are typically cylindrical in configuration, not yet having the flared end portions depicted in the drawings. Conceivably, however, the ends could be previously flared prior to placement in the first hydroforming cavity, e.g., when the tubes are pulled or rammed together or when the double tube is bent to effect any desired nonlinear configuration or angles therein. Furthermore, some double wall conduits or conduit portions need not have any bend zones, such that the cavities would have straight centerlines. If the ends are previously flared, it is still desirable to have tapered noses on the end plug for the first cavity, to hold the tubes on center in the cavity. All of these variations are considered to be part of this concept herein.

The opposite ends 16' of cavity 16 are outwardly tapered to match the configuration and angle of the tapered noses 42. Optionally, the opposite ends of cavity 14 may also have outwardly flared portions matching those of the tapered noses 22. However, it is not as necessary to have these tapered ends on cavity 14 as on cavity 16 since the interaction of the tapered noses 42 and the ends 16' of cavity 16 must function to seal between the two tube elements 50 and 52 of the workpiece at the flared ends, as described hereinafter, during the second hydroforming stage of the process.

The purpose of the two-stage hydroforming operation is to first expand or enlarge both the inner and outer tube elements simultaneously by hydroforming in first cavity 14, and thereby obtain a predetermined final inner tube dimension, and then subsequently to expand or enlarge by hydroforming only the outer element further, while not changing the size of the inner element, using the second cavity 16. The workpiece is typically bent by conventional techniques to the overall desired configuration, e.g., like that shown with two angles as in FIG. 1. This workpiece is at least mostly of smaller outside diameter than the diameter of cavity 14 and is laid in the lower part of the cavity 14, and the top platen 12' is brought down to interfit with lower platen 12. During this closing, portions of the workpiece can be partially formed by the walls of cavity 14 acting as a die. High pressure is used to hold the platen totally closed and immovable during the hydroforming operation, as by holding such in a press (not shown). Next fluid actuators 25 are shifted axially to extend the first end plug subassemblies 20 into the workpiece W and the cavity 14. Specifically, the tapered nose elements 42 are forced toward cavity 14, thereby engaging the cylindrical ends of workpiece W and flaring them outwardly as the tapered noses extend to their final position partially within cavity 14. This flaring enables the workpiece to be held on center in this cavity and also in the subsequent cavity 16. When actuator 25 inserts nose 22, it also inserts seal 28 into the cavity 14 and the workpiece a predetermined distance, past the openings 54 of inner tube 50. The second power actuators 24 are then actuated to axially extend collar 34 a small amount, thereby axially compressing the resilient annular seals 28. This causes them to radially expand into tight engagement with the ends of the inner peripheral wall of inner tube element 50, as well as rod 30, to tightly seal the ends of the inner workpiece cavity 56 axially inwardly of openings 54. Hydroforming liquid is then injected through liquid conduit 26 in at least one of the end plug subassemblies to fill space 56, while extracting the air as through a second passage 26' in the opposite end plug subassembly. The hydroforming process may be performed in a bath of liquid, e.g., water, so as to be submerged. In such a situation, filling of the workpiece will occur with submersion of the workpiece so that only a small amount of added liquid under pressure through passage 26 will be necessary for hydroforming. This variation is within the concept herein. Sufficient pressure is then applied to the liquid to simultaneously expand both the inner and outer tubular elements 50 and 52 until the outer element outer surface takes the configuration and size of cavity 14, and give the inner element its desired final dimension. At this first forming stage, any flaws, e.g., in the weld of the longitudinal seam of inner element 50, can be detected since the pressurized liquid inside cavity 56 will tend to flow through any flaw in inner element 50 to be between tube elements 50 and 52 and thus squirt out of the ends of the workpiece between the elements, causing the hydroforming liquid pressure to noticeably drop or cease to build. This first step thus acts as an excellent quality check on the inner element. The pressure is then released, seals 28 are allowed to radially retract by retracting collar 34 axially, and the end plugs with tapered noses 22 and seals are retracted from the modified workpiece W' and cavity 14. If the operation is performed under liquid, i.e., in a bath of the hydroforming liquid, there is no need to drain the workpiece when it is transferred over to second cavity 16. If the operation is not performed in a bath, then the liquid is preferably drained from the workpiece prior to transfer of the workpiece over to the second cavity. This can be done by applying air pressure, or by gravity.

Inasmuch as the size, i.e., diameter, of the second cavity is greater than that of the first cavity, there will be some slack between the outer wall of the transferred, expanded workpiece W' and the peripheral wall of the second cavity. The end plug subassemblies 40, when axially extended, cause the second pair of tapered noses 42 to engage the flared end portions of the workpiece to thereby center it in cavity 16. Prior to hydroforming pressure being applied in the second operation stage, upper platen 12' is tightly closed with lower platen 12. When the operation is to be performed in the second cavity, another workpiece W can also be placed in the first cavity and operated upon in the manner just described. At the same time, the tapered noses 42 of the second pair of end plug subassemblies 40 are inserted into cavity 16 and the workpiece W' with sufficient force to press the flared ends of inner and outer elements 50 and 52 tightly together to create a seal between them. This is to prevent hydroforming liquid from escaping between the two tube elements during the second hydroforming operation. In this stage, openings 54 are now exposed to the entire inner cavity 56 of the workpiece. Therefore, when hydroforming liquid is injected to fill space 56 and then a significant forming pressure is applied in the workpiece, the liquid will flow through openings 54 such that the pressure on both the inner wall and the outer wall of inner element 50 is equal, but there is a significant outward pressure and force on the inside wall of outer element 52, causing it to expand to the selected dimensions of cavity 16, giving the outer element its desired dimension. After this is performed, the pressure is televised and the forming liquid is drained out of the workpiece, or forced out under pressure, to empty the workpiece of liquid. Optionally, the offal at the ends of the workpiece, i.e., the flared end portions, can then be severed to leave the finished conduit product.

Those skilled in this art will conceive of various minor changes in the process or apparatus, to accommodate a particular type of material, configuration or product use, within the scope of the inventive concept set forth herein. One such variation would be to not flare the ends of the workpiece as preferred and taught, but to otherwise form the seal at both ends. Another variation would be to use only one cavity but with removable inserts or shiftable walls, to render the cavity smaller for the first hydroforming stage and larger for the second hydroforming stage. Another variation would be to have the first and second cavities in separate platens. It is not intended that the invention should be limited to the preferred embodiment set forth herein as an example, but only by the scope of the appended claims and the reasonably equivalent apparatus and methods to those defined herein.

The embodiments of the invention in which an exclusive property or privilege is claimed are defined as follows.

1. A method of forming a configurated dual tube metal conduit with controlled spacing between the inner and outer tubes comprising the steps of:

providing a dual tube workpiece of metal having a pair of open ends, an inner tube and an outer tube in telescopic engagement with each other, and openings through said inner tube adjacent at least one of said ends;

providing sealing end plugs having annular seals thereon; bending said dual tube workpiece to a predetermined configuration; inserting said sealing end plugs in said workpiece ends to a depth sufficient to cover said openings, and sealing said open ends of said workpiece;

first expanding both of said inner and outer tubes simultaneously by filling said workpiece with fluid and increasing the pressure of said fluid sufficient to cause said inner and outer walls to simultaneously expand a controlled amount to a desired size of said inner tube;

withdrawing said sealing plugs to uncover said openings; and repressurizing fluid in said workpiece to cause flow through said openings and between said inner and outer tubes, to expand only said outer tube to its final outside shape and size which results in a predetermined spacing from said inner tube, and thereby form the dual wall metal conduit.

2. The method in claim 1 including, prior to said repressurizing step, the step of outwardly pressing said ends of said inner and outer tubes together to seal said ends together to inhibit escape of pressurized fluid.

3. The method in claim 2 including the step of cutting off said flared ends as offal.

4. The method in claim 1 followed by the steps of releasing the fluid pressure and removing the fluid from said metal conduit.

5. The method in claim 1 including the step of providing first and second cavities, and wherein said first expansion step is performed with said work:piece in said first cavity, and said repressurizing step is performed with said workpiece in said second cavity.

6. The method in claim 1 including the step of flaring said workpiece ends.

7. The method in claim 6 wherein said step of flaring said workpiece ends is performed by forcing frustoconical noses into said workpiece ends.

8. The method in claim 7 wherein said flaring is performed prior to said first expansion step.

9. The method in claim 8 wherein said flaring is performed prior to said sealing of said open ends of said workpiece.

10. The method in claim 1 wherein said sealing is achieved by radially expanding said annular seals.

11. The method in claim 10 wherein said annular seals are resiliently deformable, and are axially compressed to cause the radial expansion.

12. A method of forming a dual wall metal conduit comprising the steps of:

providing a dual tube workpiece having an outer imperforate tube and an inner tube, said outer tube having its inner diameter engaging the inner tube outer diameter, said inner tube defining a central space and having openings through said inner tube adjacent to but spaced from the ends of said inner tube, and said inner and outer tubes having open axial ends;

placing said workpiece in a first cavity;

closing said open ends of said tubes and also sealing said openings off from said central space;

filling said central space with liquid and pressurizing said liquid to a pressure sufficient to expand said inner and outer elements to cause said other element to take the size of said first cavity;

releasing said pressure;

placing said tubes in a larger cavity and reclosing the ends of said tubes, but not sealing said openings;

pressurizing liquid in said central space to cause pressurized liquid to flow through said openings and between said inner and outer elements, and expand only said outer element to the size of said second cavity; and again releasing the pressure.

13. The method in claim 12 including the steps of flaring the ends of said inner and outer tubes with said step of closing said open ends of said tubes.

14. A method of forming dual tube metal conduit with controlled spacing between the inner and outer walls, comprising the steps of:

providing a dual tube conduit workpiece of metal having a pair of ends, an inner peripheral tube and an outer peripheral tube in telescopic engagement with each other, and openings through said inner tube adjacent to and spaced from said ends;

providing a first pair of tapered end plugs having an annular seal on each said end plug, and providing a second pair of tapered end plugs;

providing a first forming cavity larger than said workpiece, and providing a second forming cavity larger than said first cavity and dimensioned to match the final outer size of the conduit to be formed;

placing said workpiece into said first forming cavity;

inserting said first pair of tapered end plugs into said workpiece ends to flare said pair of ends, and inserting said annular seals into said workpiece ends to a depth sufficient to cover said openings, and sealing said openings;

filling said workpiece with fluid and increasing the pressure of said fluid sufficient to cause said inner and outer tubes to simultaneously expand a controlled amount to the size of said first forming cavity;

withdrawing said first pair of plugs from said workpiece;

placing said workpiece in said second forming cavity;

inserting said second pair of tapered end plugs into said ends of said workpiece while leaving said openings uncovered, and forcing said inner and outer tubes together sufficiently at said workpiece ends, to inhibit fluid leakage from between said tubes;

filling said workpiece with fluid;

pressurizing said fluid to cause flow through said openings and between said inner and outer tubes, to expand only said outer tube to the size of said second forming cavity and a predetermined spacing from said inner tube, but not expanding said inner tube, and thereby form the dual wall metal conduit; and releasing the fluid pressure.

15. The method in claim 14 wherein, during said step of inserting said second pair of tapered end plugs, said flared ends of said inner and outer walls are pressed together to seal said ends together.

16. The method in claim 15 including the subsequent step of cutting off said flared ends as offal.

17. A method of forming a configurated dual tube air gap metal conduit with selected enlarged controlled spacing between the inner and outer tubes comprising the steps of:

providing a dual tube metal workpiece having an inner tube and an outer tube in telescopic engagement with each other;

placing said dual tube workpiece in a mold cavity;

filling only said inner tube with fluid and increasing the pressure of said fluid in said inner tube sufficient to cause said inner and outer tubes to both expand a controlled amount in said mold cavity to a desired size of said inner tube;

positioning said workpiece in a larger mold cavity;

pressurizing fluid in said inner tube, and injecting and pressurizing fluid between said inner and outer tubes to equal pressure on the inside and the outside of said inner tube, and expanding only said outer tube to a final desired outer tube shape and size corresponding to said larger mold cavity, and thereby also causing a predetermined spacing of said outer tube from said inner tube to form a dual wall, air gap metal conduit.

18. The method in claim 17 including, prior to said repressurizing step, the step of outwardly pressing said ends of said inner and outer walls together to seal said ends together to forestall escape of pressurized fluid.

19. A method of forming a configurated dual tube air gap metal conduit with selected enlarged controlled spacing between the inner and outer tubes comprising the steps of:

providing a dual tube metal workpiece having an inner tube and an outer tube in telescopic engagement with each other;

bending said dual tube workpiece to a predetermined configuration;

placing said dual tube workpiece in a mold cavity;

filling only said inner tube with fluid and increasing the pressure of said fluid in said inner tube sufficient to cause said inner and outer tubes to both expand a controlled amount in said mold cavity to a desired size of said inner tube;

positioning said workpiece in a larger mold cavity;

pressurizing fluid in said inner tube, and injecting and pressurizing fluid between said inner and outer tubes to equal pressure on the inside and the outside of said inner tube, and expanding only said outer tube to a final desired outer tube shape and size corresponding to said larger mold cavity, and thereby also causing a predetermined spacing of said outer tube from said inner tube to form a dual wall, air gap metal conduit.

* * * * *

UNITED STATES PATENT AND TRADEMARK OFFICE

CERTIFICATE OF CORRECTION

PATENT NO. : 5,363,544

DATED : November 15, 1994

INVENTOR(S) : Gary L. Well et al

It is certified that error appears in the above-indentified patent and that said Letters Patent is hereby corrected as shown below:

Column 6, line 15;
"televised: should be --released--.

Column 7, line 12, claim 5;
"work:piece" should be --workpiece--.

Signed and Sealed this

Twenty-ninth Day of August, 1995

*Attest:*

Bruce Lehman

BRUCE LEHMAN

*Attesting Officer*

*Commissioner of Patents and Trademarks*